US006145362A

United States Patent [19]

Piispanen et al.

[11] Patent Number: 6,145,362

[45] Date of Patent: Nov. 14, 2000

[54] PROCESS AND APPARATUS FOR THE MANUFACTURE OF A COOKING VESSEL BY ROLL FORMING

[75] Inventors: Ari Piispanen; Timo Savinainen; Juha Varis; Veli Pekka Kujanpää , all of Lappeenranta; Timo Kässi, deceased, late of Launonen, all of Finland, by Leena Kassi, legal representative

[73] Assignee: Rondex Oy Ltd., Helsinki, Finland

[21] Appl. No.: 09/351,587

[22] Filed: Jul. 12, 1999

Related U.S. Application Data

[63] Continuation-in-part of application No. 08/945,562, Oct. 20, 1997, abandoned.

[30] Foreign Application Priority Data

Apr. 20, 1995 [FI] Finland ..... 951882

[51] Int. Cl.[7] ..... B21H 1/22

[52] U.S. Cl. ..... 72/82; 72/84

[58] Field of Search ..... 72/67, 82, 84, 72/115, 117

[56] References Cited

U.S. PATENT DOCUMENTS

| | | |
|---|---|---|
| 1,850,395 | 3/1932 | Hughes . |
| 2,618,258 | 11/1952 | Kroyer . |
| 4,491,235 | 1/1985 | Fournier et al. . |
| 5,465,598 | 11/1995 | Hirai et al. . |

FOREIGN PATENT DOCUMENTS

| | | |
|---|---|---|
| 0652061 | 10/1995 | European Pat. Off. . |
| 61-202740 | 9/1986 | Japan . |
| 1274836 | 2/1985 | U.S.S.R. . |
| 1639838 | 4/1989 | U.S.S.R. . |
| 2041268 | 9/1980 | United Kingdom . |
| 2104813 | 3/1983 | United Kingdom . |
| 92/06803 | 4/1992 | WIPO . |

*Primary Examiner*—Lowell A. Larson
*Attorney, Agent, or Firm*—Altera Law Group LLC

[57] ABSTRACT

A process and apparatus for the manufacture of a cooking vessel, such as a frying pan (12) or a kettle from a metal blank. The vessel is manufactured by roll forming techniques by using a lower tool (3) that rotates around its axis (2), the form face (6, 7) of the lower tool being designed so that it corresponds to the outer surface of the thus created vessel, and an upper tool (5) that rotates around its axis (4), the surface (9, 10) of the upper tool having a profile that corresponds to the inner surface formed to the vessel. The blank is placed on the form face of the lower tool and the tools (3, 5) are then made to rotate so that the blank rotates along with the lower tool (3), and the surface of the upper tool (5) is in linear roll contact with the blank, whereby the metal is formed in the slot between the tools, spreading out into the desired form of the vessel. A vertical wall on the lower tool adjacent the blank may prevent the blank from becoming dislocated on the lower tool. First, a pressure sufficient to give the blank substantially the desired form of the cooking vessel is applied. Thereafter, the pressure is reduced to finish the surfaces of the cooking vessel. In the manufacture of the frying pan (12), the blank may be a straight piece of sheet, whereby the rising sides of the pan are formed in the roll forming with the blank spreading radially outwards at its edges. In connection with the forming, the outer and inner surface of the vessel can be provided with patterns consisting of protrusions and/or recesses.

12 Claims, 3 Drawing Sheets

PROCESS AND APPARATUS FOR THE MANUFACTURE OF A COOKING VESSEL BY ROLL FORMING

This is a continuation-in-part of Ser. No. 08/945,562, filed Oct. 20, 1997, now abandoned.

FIELD OF THE INVENTION

The object of the invention is a process for the manufacture of a cooking pot or pan, such as a frying pan or a kettle, in which the pot is produced from a metal blank by forming techniques. In addition, the invention is related to equipment intended for the application of the process.

BACKGROUND OF THE INVENTION

Heretofore, frying pans and other vessels, intended for cooking, have been manufactured from metal blanks by spinning. In spinning, a sheet-like blank is attached to a rotating arbor so that the inner bottom of the produced pan is placed against the supporting surface in the arbor, after which the sides of the pan are formed by bending the edges of the blank against the sides of the arbor which serves as a mold, by using a turning tool.

One disadvantage of spinning in the manufacture of frying pans is that said turning of the blank into the form of a pan only provides one stage in a multi-phase, time-consuming manufacturing process. The finishing of the upper edge of the pan and the outer edge of the pan's bottom are carried out by turning in different stages, and the patterning of the bottom and the sides of the pan is carried out either by chipping with a turn lathe or by cold working. The grease pockets at the inner bottom of the pan, for example, are formed by compression. In the serial production of the pans, about 3 minutes in total are spent for said procedures.

SUMMARY OF THE INVENTION

The purpose of the invention is to provide a new solution for the manufacture of cooking pots and pans, especially frying pans, but also saucepans and kettles, which is simpler than the known spinning techniques. The invention is characterized in that the pot is manufactured by roll forming by using a lower tool that rotates around its axis and the form face of which is designed so that it corresponds to the outer face of the produced pot, and an upper tool that rotates around its own, separate axis, the profile of the upper tool surface corresponding to the inner surface that is formed to the pot, the manufacture being carried out by placing the blank on the form face of the lower tool and by making the tools rotate so that the blank is rotated along with the lower tool and the surface of the upper tool is in linear roll contact with the blank, whereby the metal is reshaped in the slot between the tools, spreading out into the desired form of the pot.

Roll forming is a cold-molding process based on malleability of metal, in which the forming tool that rolls on the blank forms and spreads the metal in a way that could be compared with dough kneading. Consequently, roll forming is characterized in that the blank is expanded on the area which is formed, while its material thickness is decreased. An advantage, as compared with the known spinning, is that the blank can be given a form that corresponds to the form faces of the tools in a single step of operation, which makes the process faster than before; the estimated forming time in series production is less than one minute, it only requires one machine tool which indicates space-saving and, unlike turning with a lathe, no waste is produced. Furthermore, the material thickness of the pot produced by roll forming is easy to adjust in different points in the pot, resulting in material saving and reduction in the weight of the pot. For the attachment of the frying pan handle, for example, the point of attachment of the handle is provided with a sufficient material thickness while the pan in the areas surrounding the point in question can be thinner.

In roll forming, the axis of the upper tool that is in linear contact with the blank, is preferably inclined relative to the lower tool, and the forming is carried out in the radial slot between the tools, whereby the edge of the blank is moved outwards during the forming. The blank may consist of a straight, sheet-like metal body the form of which more or less corresponds to the bottom of the vessel to be manufactured, such as a frying pan, for example, whereby the sides of the vessel are not created until during the forming with the blank spreading outwards at its edges between the tools. However, the shape of the blank is not critical with respect to the method and thus the blank does not necessarily have to be either round, of the same diameter, or even straight. In every case, the vessel will find a desired form during the forming process.

According to an advantageous embodiment of the invention, the inner and/or outer surfaces of the manufactured vessel are patterned in connection with the roll forming by using protrusions and/or recesses in the form face of the lower tool and/or on the roll surface of the upper tool. Consequently, the desired patterns are provided directly in the roll forming process and not in separate turning or compression stages as in the present manufacturing techniques. Roll forming does not set any limitations on the patterning of the outer surface of the vessel because the blank remains in place on the form face of the lower tool during the forming, completely conforming to its shapes. Annular protrusions and recesses can be formed on the inner surface of the vessel without restrictions by using corresponding figures on the surface of the upper tool. Regarding other types of patterning, the synchronization of the movements of the tool roll surface and the blank surface on the lower tool must be ensured by dividing the surfaces in suitable sectors, for example, so that the corresponding patterns of the surfaces meet repeatedly during the forming process. The conical roll surface of the suitably inclined upper tool can consist of, for example, five sectors with identical patterns which mold the six corresponding sectors that constitute the round surface of the blank and which can be patterned in accordance with the patterns on the upper tool surface. Other synchronization between the blank and the upper tool roll surface, and the tilt angles of the upper tool axis required by them are equally viable and obvious to those skilled in the art. The suggested design of the inner surface of the vessel is particularly viable when grease pockets are formed on the bottom of the frying pan.

In roll forming, the lower tool can be rotated by a motor, whereby the blank that is being formed remains in place on the form face of the lower tool under the influence of friction, and the upper tool that is provided with bearings that allow free rotation and which carries out the roll forming, can be made to rotate along with the blank and the lower tool by the influence of friction.

The forming process comprises two stages. In the first stage the pressure between the upper and lower tools is comparatively high, such that the blank attains substantially the desired form of the cooking vessel. In the subsequent second stage, a lighter pressure is applied, to finish the surfaces of the cooking vessel. This kind of cold-molding process takes less time and produces better products than a corresponding one-stage process, especially when fairly light and thin pans are being manufactured. This is because the process uses higher pressures in the first stage, and the surfaces are finished and the metal structures are stabilized in the second stage.

The equipment according to the invention for the manufacture of a heated cooking vessel by the above-described roll forming techniques is characterized in comprising a lower tool that rotates around its own axis, the form face of the lower tool having been shaped to correspond to the outer surface of the vessel to be manufactured; and an upper tool rotated around its axis and inclined with respect to the lower tool, the surface of the upper tool having a profile that corresponds to the inner surface of the manufactured vessel, and the tools can be placed against one another so that a vessel is formed from the metal blank in the radial slot between the lower tool and the upper tool that rolls with respect to the lower tool.

An embodiment of the equipment well-suited for the manufacture of frying pans in particular is characterized in that the form face of the lower tool comprises a horizontal center that corresponds to the bottom of the manufactured pan, and a rising edging that corresponds to the outer side of the manufactured pan, and that the roll surface of the upper tool consists of two parallel, conical surfaces which form the inner bottom and the sides of the pan. Blanks may have a tendency to become dislocated on the lower tool at the beginning of the forming process. This is particularly the case when using light blanks. In this embodiment, the lower tool comprises a substantially vertical wall adjacent the horizontal center. The wall may prevent the blank from becoming dislocated on the lower tool.

The equipment according to the invention may preferably consist of replaceable modules, whereby the equipment can be used to manufacture different size and shape frying pans and other similar cooking vessels by replacing some parts.

BRIEF DESCRIPTION OF THE DRAWINGS

In the following, the invention is described in detail with the aid of examples and with reference to the appended drawing in which.

DETAILED DESCRIPTION OF PREFERRED EMBODIMENTS

Figure 1:
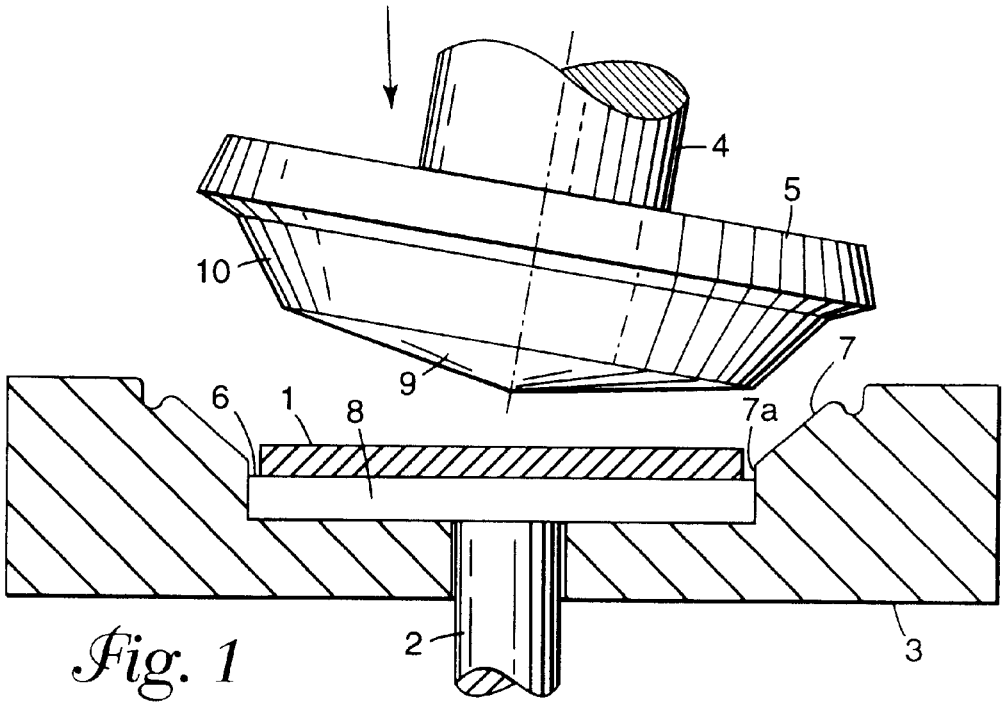
FIG. 1 presents the lower and upper tools of the roll forming equipment and the metal blank placed on the form face of the lower tool.
Figure 3:
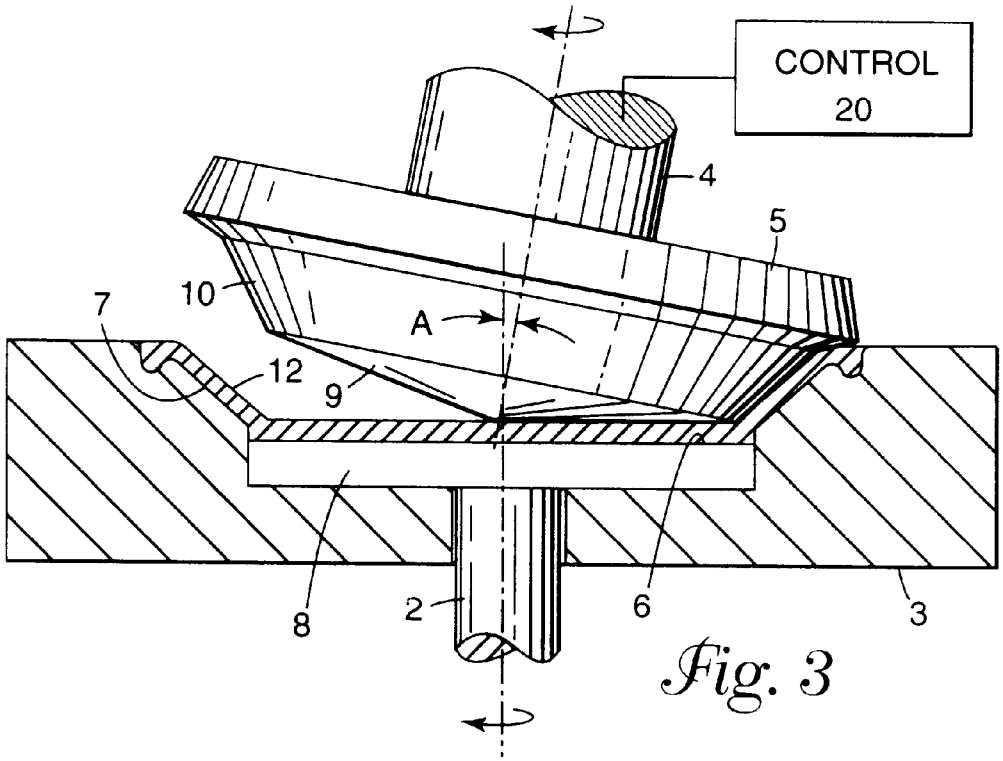
FIG. 3 presents the end result of the forming phase in which the blank has been formed into the form of a frying pan.
Figure 2:
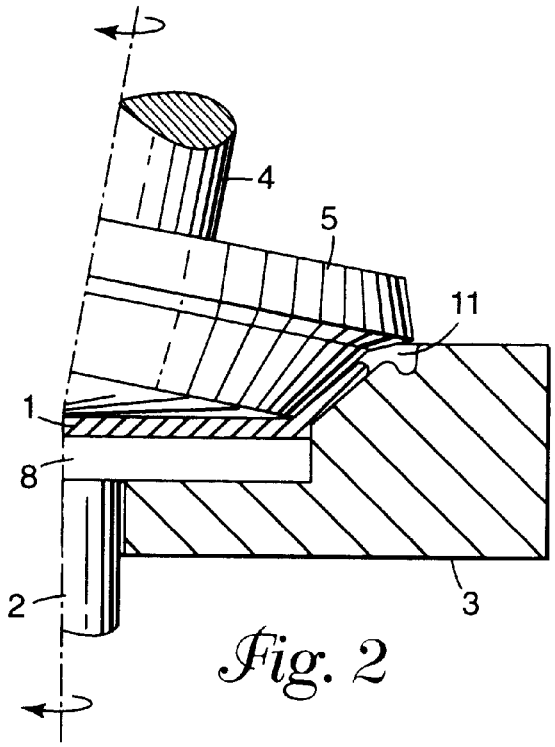
FIG. 2 presents roll forming in which the blank is being spread outwards in the slot between the tools.

FIGS. 1 to 3 present different stages of the manufacture of a frying pan by roll forming from an essentially round, sheet-like metal blank 1 which can be of, for example, aluminium or stainless steel. The roll forming equipment consists of lower tool 3 that rotates around its axis 2 and of upper tool 5 that rotates around its axis 4. Axis 4 of upper tool 5 is inclined in angle A relative to axis 2 of lower tool 3 (FIG. 3). Lower tool 3 comprises a form face the shape of which corresponds to the outer surface of the manufactured frying pan, comprising horizontal center 6 that corresponds to the bottom of the pan, and a rising edge 7 that corresponds to the outer sides of the pan. Said center 6 of the form face is part of ejector pin 8 that moves in the direction of axis 2 included in lower tool 3, the ejector pin being used to remove the completed pan from the equipment to conclude the forming. The lower tool 3 further comprises a substantially vertical wall 7*a* adjacent the center 6. The wall 7*a* may prevent the blank 1 from becoming dislocated on the lower tool 3. Upper tool 5 comprises a roll surface that forms blank 1 into a pan, the roll surface consisting of two parallel conical surfaces 9, 10 which together provide a profile that corresponds to the inner bottom 14 and sides 17 of the pan (cf. FIG. 4).

Upon placing blank 1 on form face 6 at the beginning of the forming process, lower tool 3 is made to rotate around its axis 2 by using a motor (not shown), whereby the blank rotates along with the lower tool under the influence of friction. Thereafter, upper tool 5, provided with a bearing that allows free rotation, is lowered against the surface of blank 1, whereby the movement of the blank makes it rotate around its axis 4 so that the upper tool rolls on the blank in radial linear contact with its surface. Consequently, the roll forming begins to form blank 1, as though in dough kneading, reshaping it in a malleable manner, resulting in the blank beginning to spread radially outwards in slot 11 between the tools (FIG. 2).

The process of forming blank 1 comprises two stages. In the first stage the pressure between the upper tool 5 and the lower tool 3 is fairly high. The pressure is sufficiently high for the blank 1 to attain substantially the desired form of the cooking vessel as shown in FIG. 3. In the subsequent second stage, a lighter pressure is applied, to finish the surfaces of the cooking vessel. The pressure may be reduced using control 20 connected to the upper tool 5, which control 20 reduces the pressure to a level suitable for the finishing of the surfaces of the cooking vessel. Well-known controls may be used for this purpose. The control 20 may form part of the machinery that applies the pressure between the upper tool 5 and lower tool 3. The control 20 may, for example, reduce the active pressing force of the upper tool 5 against the lower tool 3. The control 20 is shown as influencing the upper tool 5 merely for purposes of this example. It may be arranged to influence the lower tool 3, or it may be arranged to influence both upper tool 5 and lower tool 3.

The edges of the originally straight blank 1 are thus formed into the rising sides of the pan. The outer surface of the pan is formed so that a hardecker-type bottom is formed into the pan. In the concluding stage of the roll forming according to FIG. 3, the metal material of the blank has filled slot 11 between the lower and upper tools completely, and has thus reached the final shape of frying pan 12 defined by tool surfaces 6, 7, 9, 10. Finally, upper tool 5 is removed and the completed pan 12 is lifted from the form face of the lower tool by a linear movement of ejector pin 8. To finish pan 12 to provide the final product, only handle 13 (FIG. 4) must be attached after this.

Figure 4:
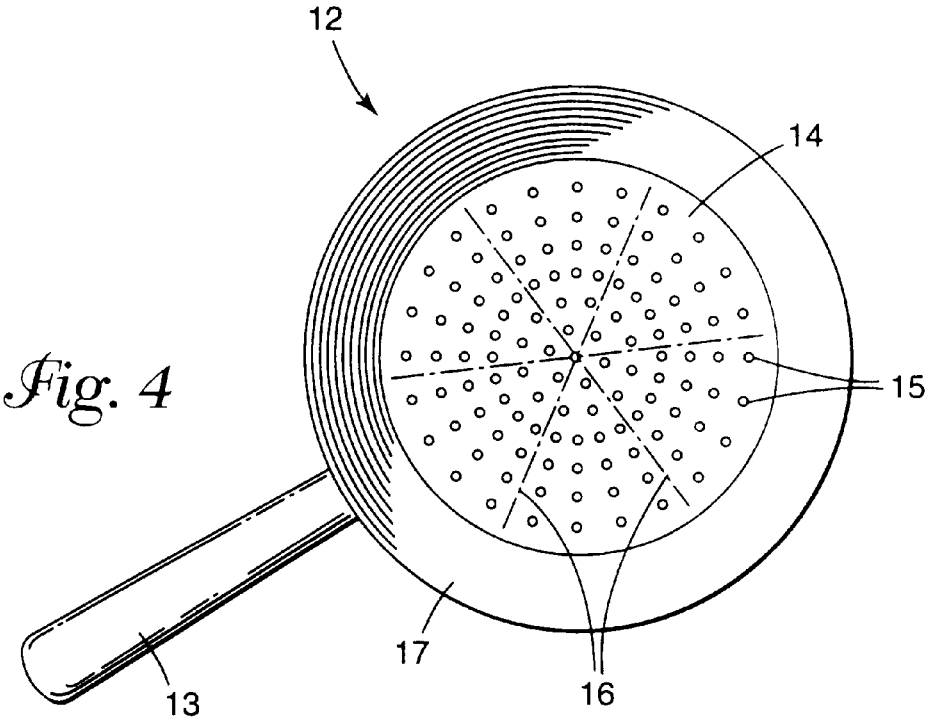
FIG. 4 is a top view of a finished frying pan provided with a handle, the bottom of which is provided with nodular protrusions provided by the roll forming.

The above-described roll forming process enables the outer and inner surfaces of the manufactured frying pan 12 to be provided with patterns or marks consisting of protrusions and/or recesses, in connection with the roll forming. The patterning of the outer surface of the pan is carried out with the aid of protrusions and recesses corresponding to the patterns made on form face 6, 7 of lower tool 3. Blank 1 that is stationary with respect to the form face conforms perfectly to the figures of the form face in the roll forming. It is possible to pattern the inner surface of the pan, correspondingly, with the aid of protrusions and recesses made on conical surfaces 9, 10 of upper tool 5. Inner bottom 14 of pan 12 presented in FIG. 4 is provided with a pattern consisting of projecting nodules 15 which can be created by using the corresponding recesses on conical surface 9 that begins from the tip of upper tool 5. Bottom 14 of the pan according to FIG. 4 can be divided in six identical sectors the limits of which are indicated by dashed lines 16 in the figure. This kind of bottom is created in roll forming with tool 5 whose conical surface 9 consists of four or five corresponding sectors, whereby the surfaces are in continuous synchronisation with one another with respect to the patterning during the roll forming.

Figure 5:
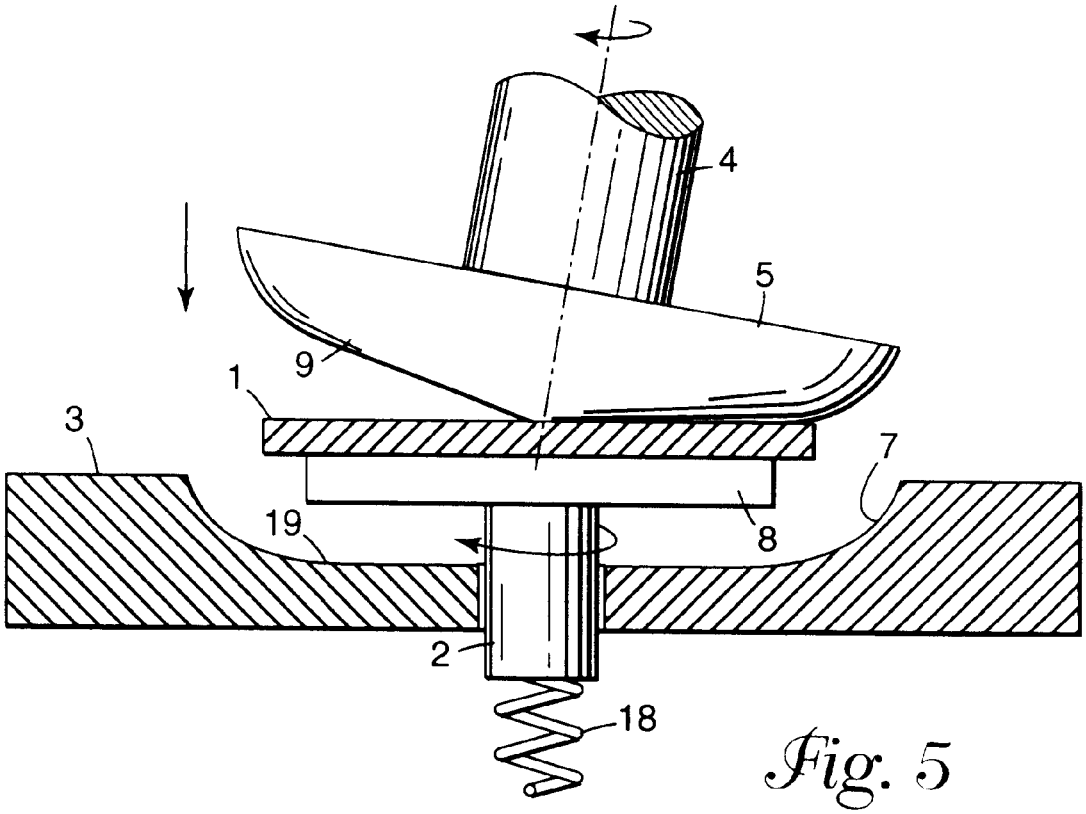
FIG. 5 presents the roll forming equipment according to another embodiment in the starting phase of the forming process.

FIG. 5 presents an alternative embodiment of the invention in which, unlike the one presented in FIGS. 1–3, arm 2 of ejector pin 8, which constitutes the rotation axis of lower tool 3, is provided with spring 18 that is loaded against upper tool 5 during the forming process. The starting point of the process is that ejector pin 8 is slightly above form face 7 of lower tool 3, pushed by spring 18, and blank 1 from which the frying pans is formed is placed on the ejector pin. Upper tool 5 that is inclined with respect to lower tool 3, comprising roll surface 9 that corresponds to form face 7 of the lower tool is then pressed against blank 1 to the position according to FIG. 5, and further downwards against spring 18 so that ejector pin 8 is pressed to corresponding recess 19 in lower tool 3. The roll forming process in which blank 1 is formed into the form of a frying pan is then carried out in a manner similar to the embodiment of FIGS. 1–3. In this case, form face 7 of the lower tool and roll surface 9 of the upper tool are shaped so that the sides of the frying pan will be rounded. After the forming process, upper tool 5 is lifted back to its starting position, whereby spring 18 of ejector pin 8 automatically lifts the pan in its final shape from form face 7 of the lower tool.

It is clear to those skilled in the art that the different applications of the invention are not limited to the examples presented above but can vary within the appended claims. Consequently, even though only the manufacture of a frying pan is described in the examples, to which the roll forming process is particularly well-suited because of the shape of the pan, the corresponding techniques may also be used for the manufacture of a saucepan or a kettle, according to the invention. The possible patterns of the outer and inner surfaces of the vessel may also be varied extensively.

We claim:

1. A process for manufacturing a cooking vessel, wherein the vessel is formed from a metal blank, the method comprising:

placing the blank on a form face of a lower tool, rotatable around a first axis, wherein the form face of the lower tool is adapted to correspond to an outer surface of the cooking vessel;

bringing an upper tool in contact with the blank, the upper tool being rotatable around a second axis, wherein a surface of the upper tool is adapted to correspond to an inner surface of the cooking vessel;

rotating the lower tool and the blank along with it, whereby the surface of the upper tool is in linear roll contact with the blank; and forming the blank in a slot between the upper and lower tools by applying a sufficient pressure between the upper and lower tools to give the blank substantially a desired form of the cooking vessel, and then reducing the pressure to finish surfaces of the cooking vessel.

2. A process according to claim 1, wherein the second axis is inclined with respect to the first axis, and wherein forming the blank in the slot between the tools comprises an edge of the blank moving outward during forming.

3. A process according to claim 2, wherein forming the blank includes using a straight sheet-like blank, and includes forming rising sides of the cooking vessel by spreading the blank at its edge during forming.

4. A process according to claim 3, wherein the cooking vessel is an aluminum frying pan.

5. A process according to claim 1, further comprising patterning at least one of the outer and inner surfaces of the cooking vessel while forming the cooking vessel, using at least one of protrusions and recesses on at least one of the form face of the lower tool and the surface of the upper tool.

6. A process according to claim 1, wherein rotating the lower tool is carried out using a motor, further comprising providing the upper tool with a bearing allowing it to rotate freely along with the lower tool and the blank.

7. A process according to claim 1, further comprising preventing the blank from becoming dislocated on the lower tool by providing a substantially vertical wall on the lower tool adjacent the blank.

8. An apparatus for manufacturing a cooking vessel, wherein the vessel is formed from a metal blank, the apparatus comprising:

a lower tool, rotatable around a first axis, having a form face adapted to correspond to an outer surface of the metal cooking vessel;

an upper tool, inclined with respect to the lower tool and rotatable around a second axis, the upper tool having a surface adapted to correspond to an inner surface of the metal cooking vessel, wherein the lower and upper tools can be placed against each other to form the metal cooking vessel in a radial slot between the lower tool and the upper tool rotating with the lower tool; and means for reducing a pressure between the upper and lower tools after the blank has acquired substantially a desired form of the cooking vessel to finish surfaces of the cooking vessel.

9. An apparatus according to claim 8, wherein the form face of the lower tool further comprises a horizontal center corresponding to a bottom of the metal cooking vessel, and wherein the surface of the upper tool consists of two conical surfaces for forming an inner bottom and sides of the metal cooking vessel.

10. An apparatus according to claim 9, wherein the lower tool further comprises a substantially vertical wall adjacent the horizontal center.

11. An apparatus according to claim 8, wherein the lower tool is connected to a motor rotating the first axis, and wherein the upper tool includes a bearing allowing it to rotate freely.

12. An apparatus according to claim 8, wherein a center part of the lower tool is axially movable for providing an ejector pin for the metal cooking vessel.

* * * * *